US005286027A

United States Patent [19]

Koumarianos

[11] Patent Number: 5,286,027

[45] Date of Patent: Feb. 15, 1994

[54] GOLF PUTTER

[76] Inventor: Angelo Koumarianos, 248 24 Ave., So. Seaside Park, N.J. 08752

[21] Appl. No.: 970,136

[22] Filed: Oct. 30, 1992

[51] Int. Cl.[5] ..... A63B 53/04

[52] U.S. Cl. ..... 273/167 A; 273/174; 273/164.1

[58] Field of Search ..... 273/167 R-77 A, 273/164.1, 164.2, 193 R, 194 R

[56] References Cited

U.S. PATENT DOCUMENTS

| | | | |
|---|---|---|---|
| 2,255,332 | 9/1941 | Russell | 273/77 R |
| 2,426,274 | 8/1947 | Kramer | 273/174 |
| 2,708,579 | 5/1955 | Hugman | 273/174 X |
| 3,199,873 | 8/1965 | Surratt | 273/174 X |
| 3,408,074 | 10/1968 | Antonious | 273/169 X |
| 3,680,868 | 8/1972 | Jacob | 273/167 AX |
| 3,806,129 | 4/1974 | Burrows | 273/167 FX |
| 3,815,921 | 6/1974 | Turner | 273/167 AX |
| 4,332,388 | 6/1982 | Crow | 273/167 AX |
| 4,535,992 | 8/1985 | Slagle | 273/174 X |

*Primary Examiner*—Jessica J. Harrison
*Assistant Examiner*—Sebastiano Passaniti
*Attorney, Agent, or Firm*—Clifford G. Frayne

[57] ABSTRACT

A golf putter having a handle and a putter head, the putter head having formed on its bottom surface, three spherical supports for elevation of the putter head above the putting surface, there being formed in the bottom of the putter head, a recessed channel between the spherical supports to aid in the passage of irregularities and debris on the putting surface from the ball-striking surface to the trailing surface.

1 Claim, 1 Drawing Sheet

GOLF PUTTER

BACKGROUND OF THE INVENTION

1. Field of Invention

The invention relates to an improved golf putter which improves the orientation of the club head when striking the golf ball so as to improve putting accuracy.

2. Description of the Prior Art

In the prior art, there are many designs for golf putters which attempt to aid the golfer in the alignment of putts for better accuracy and for improving the manner in which the putter intracts with the golf ball during the putting stroke. There is, however, a need for a golf putter which performs the above-identified aids for the golfer, but also is capable of interacting with the putting surface so as to aid the golfer in moving the putter head in a straight line so as to improve putting accuracy.

OBJECT OF THE INVENTION

An object of the present invention is to provide an improved golf putter in which the club head is formed so as to orient the club head with respect to the ball and the putting surface.

A further object of the present invention is to provide for an improved golf putter which aides in the alignment of the putter head and golf ball with the hole.

A still further object of the present invention is to provide for an improved golf putter in which the sole of the putter interacts with the putting surface to improve putting accuracy.

SUMMARY OF THE INVENTION

A golf putter which has a shaft with a handle portion at one end, and a club head at the opposing end of the shaft, the club head having a forward ball-engaging surface, an opposing rear surface, an upper surface, a bottom surface, and a heel portion and a toe portion, the bottom surface of the club head having formed thereon, a plurality of depending spherical supports with recessed channels positioned therebetween, the depending spherical supports and recessed channels cooperative to orient the club face perpendicular to the path of movement of the club head and to prevent the bottom surface of the club head from engaging any putting surface irregularities, the rear surface and top surface of the club head having a semi-circular protrusion extending rearwardly to provide a centrally-positioned weight to the club head.

BRIEF DESCRIPTION OF THE DRAWINGS

The objects of the present invention as well as other advantages will be apparent, particularly when taken in light of the accompanying drawings wherein.

DETAILED DESCRIPTION OF THE DRAWINGS

Figure 1:
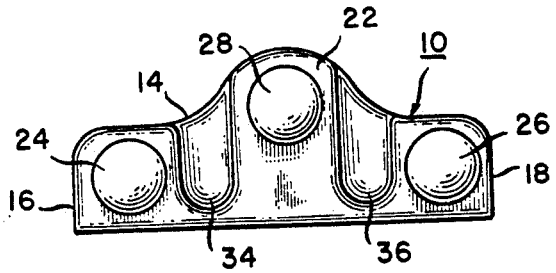
FIG. 1 is a bottom view of the putter head.

Referring to FIG. 1, there is shown a bottom view of putter head 10 which is comprised of a ball-engaging front surface 12, a rear or trailing surface 14, a heel end portion 16 and a toe end portion 18. The heel end portion 16 of putter head 10 is typically oriented towards the golfer when executing a putting stroke and the toe end portion 18 of putter head 10 is typically oriented away from the golfer during the putting stroke.

Figure 3:
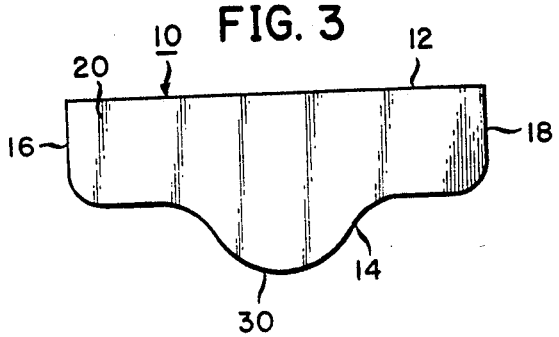
FIG. 3 is a top view of the putter head.

FIG. 3 is a top view of putter head 10 illustrating the generally planar top surface 20. Bottom surface 22, as illustrated in FIG. 1, has a first spherical support 24 formed thereon proximate to heel end portion 16 and a second spherical support 26 formed thereon proximate to toe end portion 18.

As illustrated in FIGS. 1 and 3, rear surface 14 has a centrally-disposed semi-circular protrusion 30 positioned midway between heel end portion 16 and toe end portion 18. A third spherical support 28 is formed on bottom surface 22 within the area of the centrally-disposed semi-circular protrusion 30 such that third spherical support 28 is positioned midway between first spherical support 24 and second spherical support 26 and slightly rearwardly therefrom.

Figure 5:
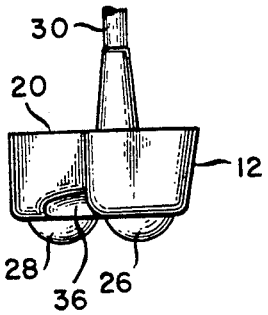
FIG. 5 is a side view of the putter head.
Figure 4:
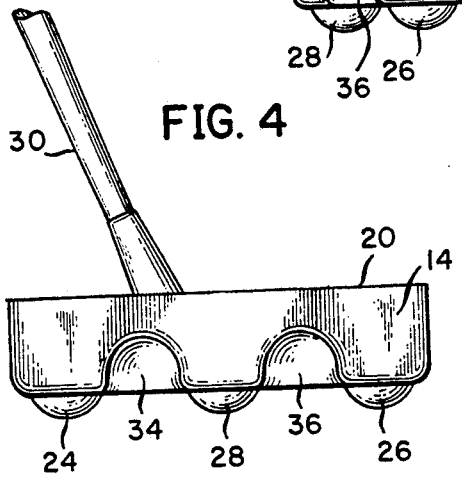
FIG. 4 is a rear view of the putter head.
Figure 2:
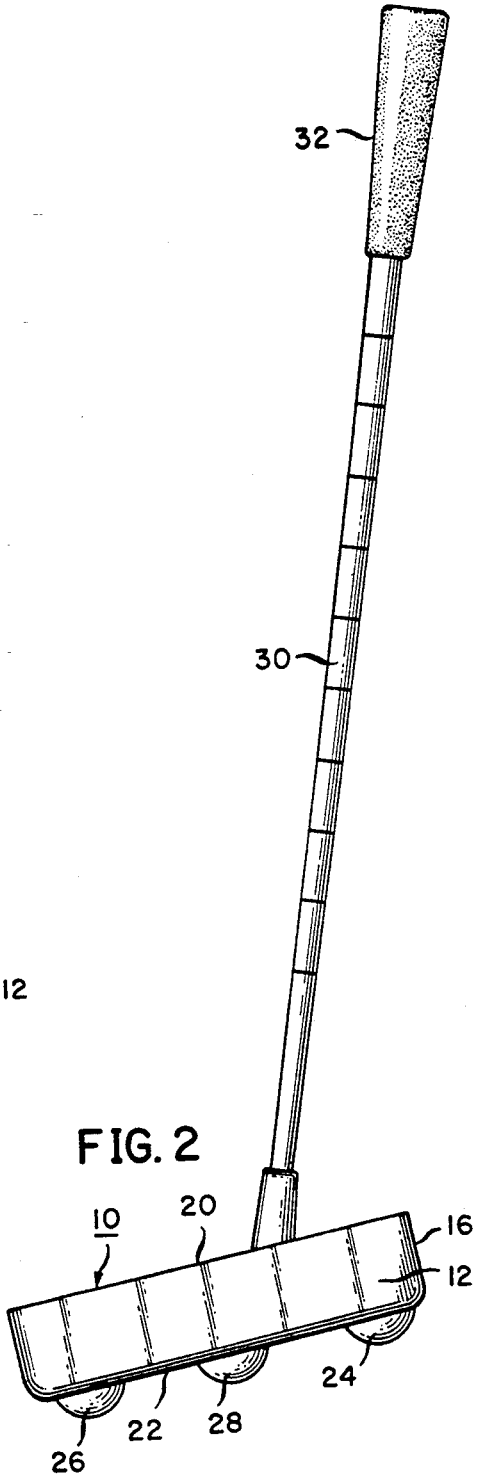
FIG. 2 is a front view of the putter head and shaft assembly.

Spherical support 24, 26 and 28 are formed on bottom surface 22 of putter head 10 in order to elevate bottom surface 22 above the putting surface. This is best illustrated with respect to FIGS. 2, 4 and 5 which are a front view of the putter head and shaft assembly; a rear view of the putter head and a side view of the putter head respectively. FIG. 2 illustrates putter head 10 secured to shaft means 30, shaft means 30 having a handle end 32 for engagement by the golfer in executing the putting stroke. Spherical supports 24, 26 and 28 serve to elevate bottom surface 22 above the putting surface and thus prevent ball-engaging front surface 12 from inadvertently contacting the putting surface during the putting stroke. In this manner, surface irregularities and/or debris on the putting surface passes beneath ball-engaging surface 12.

The passage of irregularities or debris beneath putter head 10 is further augmented by a pair of recessed channels 34 and 36 formed in bottom surface 22. Recessed channel 34 is formed between spherical support 24 and spherical support 28 and recessed channel 36 is formed between spherical support 26 and spherical support 28. Recessed channel 34 and 36 commence at a point on bottom surface 22 rearwardly of ball-engaging surface 12 and extend rearwardly therefrom to rear surface 14, recessed channels 34 and 36 serving to channel surface irregularities and any debris or impediments rearwardly thereby reducing the opportunity for the twisting of putter head 10 during its forward movement in the putting stroke.

Spherical supports 24, 26 and 28 also serve to provide stability to putter head 10 during the putting stroke. Spherical supports 24 and 26 add additional heel and toe weighting to the putter head 10 in order to decrease the possibility of twisting of the putter head during the putting stroke and spherical support 28 provides additional weighting on the center of gravity of the putter head so as to impart additional force to the golf ball when struck.

While the present invention has been described in connection with the exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

I claim:

1. A golf putter having a handle and a putter head, said putter head having a ball-engaging surface, a trailing surface, a top surface, a bottom surface, a heel portion and a toe portion, said ball-engaging surface being substantially vertically planer, said trailing surface being curvilinear and having a rearwardly-extending protrusion centrally positioned thereon, a first spherical support and a second spherical support formed on said bottom surface and depending therefrom, said first spherical support located proximate said heel portion and said second spherical support located proximate said toe portion, a third spherical support spaced rearwardly from said first and second spherical supports, said third spherical support located proximate said protrusion in said trailing surface; a first recessed channel disposed between said first spherical support and said third spherical support and a second recessed channel disposed between said second spherical support and said third spherical support, said first and second recessed channels extending rearwardly from a point proximate to said ball-engaging surface to said trailing surface.

* * * * *